US010332461B2

(12) United States Patent
Chen et al.

(10) Patent No.: US 10,332,461 B2
(45) Date of Patent: Jun. 25, 2019

(54) GRAYSCALE VOLTAGE DEBUGGING METHOD AND DEVICE, AND DISPLAY DEVICE

(71) Applicants: BOE TECHNOLOGY GROUP CO., LTD., Beijing (CN); CHONGQING BOE OPTOELECTRONICS TECHNOLOGY CO., LTD., Chongqing (CN)

(72) Inventors: Shuai Chen, Beijing (CN); Zhi Zhang, Beijing (CN); Lijun Xiao, Beijing (CN); Shaoru Li, Beijing (CN); Keke Gu, Beijing (CN); Zhihui Wang, Beijing (CN); Taoliang Tang, Beijing (CN); Qian Qian, Beijing (CN); Zhijian Qi, Beijing (CN); Yi Dan, Beijing (CN); Lisheng Liang, Beijing (CN)

(73) Assignees: BOE TECHNOLOGY GROUP CO., LTD., Beijing (CN); CHONGQING BOE OPTOELECTRONICS TECHNOLOGY CO., LTD., Beibei, Chongqing (CN)

( * ) Notice: Subject to any disclaimer, the term of this patent is extended or adjusted under 35 U.S.C. 154(b) by 0 days.

(21) Appl. No.: 15/536,188

(22) PCT Filed: Sep. 14, 2016

(86) PCT No.: PCT/CN2016/098978
§ 371 (c)(1),
(2) Date: Jun. 15, 2017

(87) PCT Pub. No.: WO2017/143764
PCT Pub. Date: Aug. 31, 2017

(65) Prior Publication Data

US 2018/0366073 A1 Dec. 20, 2018

(30) Foreign Application Priority Data

Feb. 26, 2016 (CN) ..... 2016 1 0108697

(51) Int. Cl.
*G09G 5/10* (2006.01)
*G09G 3/36* (2006.01)

(52) U.S. Cl.
CPC ..... *G09G 3/3607* (2013.01); *G09G 3/36* (2013.01); *G09G 2310/08* (2013.01); *G09G 2320/0233* (2013.01); *G09G 2320/0673* (2013.01)

(58) Field of Classification Search
CPC ..... G09G 3/3688; G09G 3/3648
See application file for complete search history.

(56) References Cited

U.S. PATENT DOCUMENTS 9,165,496 B1 * 10/2015 Jung ..... G09G 3/3225
2014/0198134 A1 * 7/2014 Moon ..... G09G 5/10 345/690

(Continued)

FOREIGN PATENT DOCUMENTS

CN 103325357 A 9/2013
CN 103700336 A 4/2014

(Continued)

OTHER PUBLICATIONS

International Search Report and Written Opinion for Application No. PCT/CN2016/098978, dated Dec. 12, 2016, 13 Pages.

*Primary Examiner* — Nan-Ying Yang
(74) *Attorney, Agent, or Firm* — Brooks Kushman P.C.

(57) ABSTRACT

It is provided a grayscale voltage debugging method for debugging a display device including a white subpixel, including a first step of, in a state where the white subpixel is disenabled and subpixels in other colors are enabled, adjusting a respective to-be-adjusted grayscale voltage (Continued)

applied to each of the subpixels in other colors, so that a first actually-measured Gamma curve corresponding to the respective adjusted grayscale voltage is located within an acceptable range of a standard Gamma curve, and a second step of, in a state where the white subpixel and the subpixels in other colors are all enabled, acquiring a second actually-measured Gamma curve and in the case that the second actually-measured Gamma curve is not located within the acceptable range, changing the respective adjusted grayscale voltage to obtain a new respective to-be-adjusted grayscale voltage, and returning to the first step.

15 Claims, 3 Drawing Sheets

(56) References Cited

U.S. PATENT DOCUMENTS

| | | | |
|---|---|---|---|
| 2016/0042698 | A1 | 2/2016 | Yang et al. |
| 2016/0343340 | A1 | 11/2016 | Zheng et al. |

FOREIGN PATENT DOCUMENTS

| | | | |
|---|---|---|---|
| CN | 105096890 | A | 11/2015 |
| CN | 105185286 | A | 12/2015 |
| CN | 105575351 | A | 5/2016 |
| JP | 2006258850 | A | 9/2006 |
| WO | 2006068224 | A1 | 6/2006 |

* cited by examiner

GRAYSCALE VOLTAGE DEBUGGING METHOD AND DEVICE, AND DISPLAY DEVICE

CROSS-REFERENCE TO RELATED APPLICATIONS

This application is the U.S. national phase of PCT Application No. PCT/CN2016/098978 filed on Sep. 14, 2016, which claims priority to Chinese Patent Application No. 201610108697.3 filed on Feb. 26, 2016, the disclosures of which are incorporated in their entirety by reference herein.

TECHNICAL FIELD

The present disclosure relates to the field of display technology, in particular to a grayscale voltage debugging method, a grayscale voltage debugging device, and a display device.

BACKGROUND

In the related liquid crystal technology, each pixel consists of three subpixels in different colors, i.e., red (R), green (G) and blue (B) subpixels. For a red-green-blue-white (RGBW) technique, a white subpixel is added on the basis of the RGB subpixels, so a RGBW panel includes four subpixels in different colors. Due to such advantages as high brightness, low power consumption and low manufacture cost, the RGBW panel has quickly become a very popular product. However, due to the introduction of the white subpixel, the debugging of a grayscale voltage may be adversely affected to some extent, and the grayscale voltage of the RGBW panel may no longer be controlled by a Gamma Integrated Circuit (IC), i.e., a grayscale voltage debugging method for a RGB panel may no longer be applicable to the RGBW panel.

SUMMARY

An object of the present disclosure is to provide a grayscale voltage debugging method, a grayscale voltage debugging device and a display device, so as to reduce the influence of the white subpixel on the debugging of the grayscale voltages.

In one aspect, the present disclosure provides in some embodiments a grayscale voltage debugging method for debugging a display device including a white subpixel, including: a first step of, in a state where the white subpixel of the display device is disenabled and subpixels in other colors are enabled, adjusting, in a pixel-by-pixel manner, a respective to-be-adjusted grayscale voltage applied to each of the subpixels in other colors of a display module, so that a first actually-measured Gamma curve corresponding to the respective adjusted grayscale voltage applied to each of the subpixels in other colors is located within an acceptable range of a standard Gamma curve; and a second step of, in a state where the white subpixel and the subpixels in other colors of the display device are all enabled, acquiring a second actually-measured Gamma curve in accordance with the respective adjusted grayscale voltage applied to each of the subpixels in other colors and a grayscale voltage applied by a time controller (TCON) to the white subpixel, determining whether or not the second actually-measured Gamma curve is located within the acceptable range of the standard Gamma curve, and in the case that the second actually-measured Gamma curve is not located within the acceptable range of the standard Gamma curve, changing the respective adjusted grayscale voltage applied to each of the subpixels in other colors, taking the changed grayscale voltage as a new respective to-be-adjusted grayscale voltage, and returning to the first step.

In a possible embodiment of the present disclosure, in the case that the second actually-measured Gamma curve is located within the acceptable range of the standard Gamma curve, the grayscale voltage debugging method further includes: selecting an abnormal grayscale corresponding to the second actually-measured Gamma curve; and adjusting the grayscale voltage applied to the white subpixel corresponding to the abnormal grayscale, so as to enable a difference between the standard Gamma curve and the second actually-measured Gamma curve at the abnormal grayscale to be within a first predetermined range.

In a possible embodiment of the present disclosure, the first predetermined range is a range within which a brightness value of the actually-measured Gamma curve is not greater than 110% and not smaller than 90% of a brightness value of the standard Gamma curve.

In a possible embodiment of the present disclosure, the step of adjusting the grayscale voltage applied to the white subpixel corresponding to the abnormal grayscale includes: in the case that there is a positive difference between the second actually-measured Gamma curve and the standard Gamma curve at the abnormal grayscale, decreasing the grayscale voltage applied to the white subpixel corresponding to the abnormal grayscale in accordance with a predetermined first adjustment ratio; in the case that there is a negative difference between the second actually-measured Gamma curve and the standard Gamma curve at the abnormal grayscale, increasing the grayscale voltage applied to the white subpixel corresponding to the abnormal grayscale in accordance with a predetermined second adjustment ratio; and determining whether or not there is still a difference between the second actually-measured Gamma curve and the standard Gamma curve at the abnormal grayscale after the adjustment of the grayscale voltage applied to the white subpixel corresponding to the abnormal grayscale, and in the case that there is still the difference, continuing to decrease or increase the grayscale voltage applied to the white subpixel corresponding to the abnormal grayscale in accordance with the predetermined first or second adjustment ratio.

In a possible embodiment of the present disclosure, the first adjustment ratio and the second adjustment ratio are each within a range from 0.1% to 5%.

In a possible embodiment of the present disclosure, the abnormal grayscale includes, among all the grayscales, top 20 to 30 grayscales at which there are the largest differences between transmittances of the actually-measured Gamma curve and transmittances of the standard Gamma curve.

In another aspect, the present disclosure provides in some embodiments a grayscale voltage debugging device for debugging a display device including a white subpixel, including: a first debugging module configured to, in a state where the white subpixel of the display device is disenabled and subpixels in other colors are enabled, adjust, in a pixel-by-pixel manner, a respective to-be-adjusted grayscale voltage applied to each of the subpixels in other colors of a display module, so that a first actually-measured Gamma curve corresponding to the respective adjusted grayscale voltage applied to each of the subpixels in other colors is located within an acceptable range of a standard Gamma curve; and a second debugging module configured to, in a state where the white subpixel and the subpixels in other colors of the display device are all enabled, acquire a second actually-measured Gamma curve in accordance with the respective adjusted grayscale voltage applied to each of the subpixels in other colors and a grayscale voltage applied by a time controller (TCON) to the white subpixel, determine whether or not the second actually-measured Gamma curve is located within the acceptable range of the standard Gamma curve, and in the case that the second actually-measured Gamma curve is not located within the acceptable range of the standard Gamma curve, change the respective adjusted grayscale voltage applied to each of the subpixels in other colors, and take the changed grayscale voltage as a new respective to-be-adjusted grayscale voltage, and return to the first step.

In a possible embodiment of the present disclosure, the grayscale voltage debugging device further includes: an abnormal grayscale selection module configured to select an abnormal grayscale corresponding to the second actually-measured Gamma curve, in the case that the second debugging module determines that the second actually-measured Gamma curve is not located within the acceptable range of the standard Gamma curve; and an abnormal grayscale adjustment module configured to adjust the grayscale voltage applied to the white subpixel corresponding to the abnormal grayscale, so as to enable a difference between the standard Gamma curve and the second actually-measured Gamma curve at the abnormal grayscale to be within a first predetermined range.

In a possible embodiment of the present disclosure, the first predetermined range is a range within which a brightness value of the actually-measured Gamma curve is not greater than 110% and not smaller than 90% of a brightness value of the standard Gamma curve.

In a possible embodiment of the present disclosure, the abnormal grayscale adjustment module includes: a positive adjustment unit configured to, in the case that there is a positive difference between the second actually-measured Gamma curve and the standard Gamma curve at the abnormal grayscale, decrease the grayscale voltage applied to the white subpixel corresponding to the abnormal grayscale in accordance with a predetermined first adjustment ratio; a negative adjustment unit configured to, in the case that there is a negative difference between the second actually-measured Gamma curve and the standard Gamma curve at the abnormal grayscale, increase the grayscale voltage applied to the white subpixel corresponding to the abnormal grayscale in accordance with a predetermined second adjustment ratio; and a difference determination unit configured to determine whether or not there is still a difference between the second actually-measured Gamma curve and the standard Gamma curve at the abnormal grayscale after the adjustment of the grayscale voltage applied to the white subpixel corresponding to the abnormal grayscale, and in the case that there is still the difference, enable the operation of the positive adjustment unit or the negative adjustment unit.

In a possible embodiment of the present disclosure, the first adjustment ratio and the second adjustment ratio are each within a range from 0.1% to 5%.

In a possible embodiment of the present disclosure, the abnormal grayscale includes, among all the grayscales, top 20 to 30 grayscales at which there are the largest differences between transmittances of the actually-measured Gamma curve and transmittances of the standard Gamma curve.

In yet another aspect, the present disclosure further provides in some embodiments a display device including the above-mentioned grayscale voltage debugging device.

In a possible embodiment of the present disclosure, the time controller is provided with an interface for adjusting a grayscale voltage applied to a white subpixel.

DETAILED DESCRIPTION

In order to make the technical solutions and the advantages of the present disclosure more apparent, the present disclosure will be described hereinafter in a clear and complete manner in conjunction with the drawings and embodiments.

Figure 1:
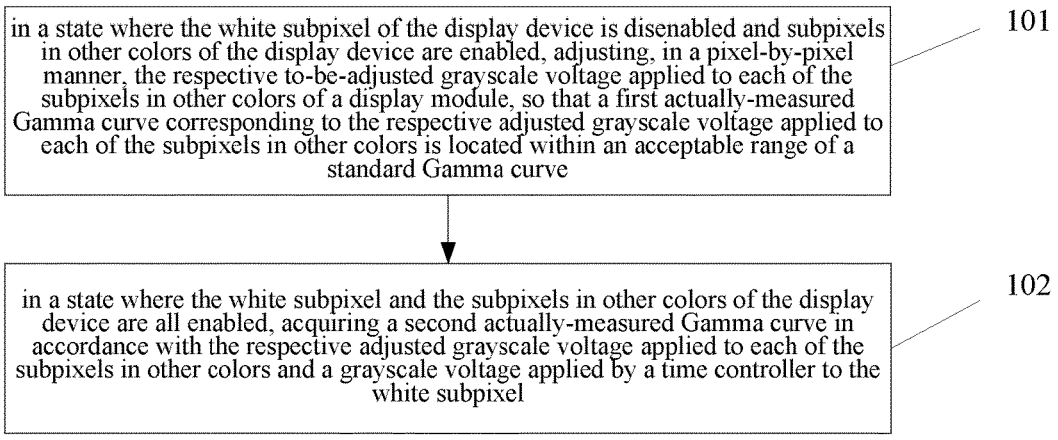
FIG. 1 is a flow chart of a grayscale voltage debugging method according to some embodiments of the present disclosure.

The present disclosure provides in some embodiments a grayscale voltage debugging method for debugging a display device including a white subpixel which, as shown in FIG. 1, includes: Step 101 of, in a state where the white subpixel of the display device is disenabled and subpixels in other colors are enabled, adjusting, in a pixel-by-pixel manner, a respective to-be-adjusted grayscale voltage applied to each of the subpixels in other colors of a display module, so that a first actually-measured Gamma curve corresponding to the respective adjusted grayscale voltage applied to each of the subpixels in other colors is located within an acceptable range of a standard Gamma curve; Step 102 of, in a state where the white subpixel and the subpixels in other colors of the display device are all enabled, acquiring a second actually-measured Gamma curve in accordance with the respective adjusted grayscale voltage applied to each of the subpixels in other colors and a grayscale voltage applied by a time controller to the white subpixel; and Step 103 of determining whether or not the second actually-measured Gamma curve is located within the acceptable range of the standard Gamma curve, and in the case that the second actually-measured Gamma curve is not located within the acceptable range of the standard Gamma curve, changing the respective adjusted grayscale voltage applied to each of the subpixels in other colors, taking the changed grayscale voltage as a new respective to-be-adjusted grayscale voltage, and returning to the Step 101.

The grayscale voltage $V_W$ applied to the white subpixel of a RGBW panel may be calculated through the following equation:

$$V_W=f(V_R,V_G,V_B) \quad (1),$$

where $V_R$ represents a grayscale voltage applied to a red subpixel, $V_G$ represents a grayscale voltage applied to a green subpixel, $V_B$ represents a grayscale voltage applied to a blue subpixel, and $V_W$ is determined in the case that a code algorithm is written into the TCON.

Presumed that there is a following relationship between the grayscale voltage V'and a brightness value:

$$Lum=g(V') \quad (2),$$

the brightness value Lum of the RGBW panel may be calculated through the following equation:

$$Lum=g(V_R,V_G,V_B,V_W) \quad (3).$$

Through substituting the formula (1) into the formula (3), the following formula may be acquired:

$$Lum=g[V_R,V_G,V_B,f(V_R,V_G,V_B)]\approx g^1(V_R,V_G,V_B) \quad (4).$$

As can be seen from the formula (4), the brightness value of the RGBW panel mainly depends on the grayscale voltages applied to the RGB subpixels. However, due to the existence of the white subpixel, the resultant Gamma curve will not be so smooth.

In the embodiments of the present disclosure, the chip of the TCON is further provided with an interface of adjusting the grayscale voltage applied to the white subpixel, and the above formula (1) may be improved, so as to acquire the following formula:

$$V_W=f(V_R,V_G,V_B)+V \quad (5).$$

In the formula (5), V may represent, in the state where the white subpixel and the subpixels in other colors are all enabled, a grayscale voltage adjustment value for further adjusting the grayscale voltage applied to the white subpixel, so as to enable the actually-measured Gamma curve, acquired after the adjustment of the grayscale voltage applied to the white subpixel corresponding to the abnormal grayscale in accordance with an adjustment error of the RGB subpixels, to be close to the standard Gamma curve. Hence, the formula for calculating the brightness value of the RGBW panel may be improved so as to acquire the following formula:

$$Lum=g[V_R,V_G,V_B,f(V_R,V_G,V_B)+V]=g''(V_R,V_G,V_B,\mathrm{V}) \quad (6).$$

According to the grayscale voltage debugging method in the embodiments of the present disclosure, the white subpixel is disenabled and the subpixels in other colors are enabled, and then the grayscale voltages applied to the RGB subpixels are adjusted, so as to reduce the influence of the white subpixel on the debugging of the grayscale voltages. After the grayscale voltages are adjusted in the state where the white subpixel is disenabled, the white subpixel is enabled, the grayscale voltages applied to all of the subpixels are adjusted, such that the Gamma curve is in the acceptable range when all of the subpixels are enabled, and thus the error due to the adjustment of the grayscale voltage applied to the white subpixel is reduced.

In a possible embodiment of the present disclosure, the white subpixel may be disenable and enabled through the TCON. In the state where the whit subpixel is enabled, the grayscale voltage applied to the white subpixel may be dynamically adjusted through the interface of the TCON in accordance with the grayscale voltage adjustment value acquired in the state where the white subpixel is disenabled.

In a possible embodiment of the present disclosure, in the case that there is a positive difference between the actually-measured Gamma curve and the standard Gamma curve, the grayscale voltage may be decreased, and in the case that there is a negative difference between the actually-measured Gamma curve and the standard Gamma curve, the grayscale voltage may be increased. To be specific, the transmittances may be collected by a brightness value collection device, and then the actually-measured Gamma curve may be acquired in accordance with the collected transmittances.

In some embodiment of the present disclosure, in the case that a determination result in Step 103 is yes, the respective adjusted grayscale voltage applied to each of the subpixels in other colors and the current grayscale voltage applied to the white subpixel may be taken as the final grayscale voltages, without any further adjustment.

In some embodiments of the present disclosure, in the case that the determination result in Step 103 is yes, the adjusted grayscale voltage may be taken as a preliminarily-adjusted grayscale voltage. At this time, the grayscale voltage debugging method may further include: selecting an abnormal grayscale corresponding to the second actually-measured Gamma curve; and adjusting the preliminarily-adjusted grayscale voltage applied to the white subpixel corresponding to the abnormal grayscale, so as to enable a difference between the standard Gamma curve and the second actually-measured Gamma curve at the grayscale to be within a first predetermined range.

In a possible embodiment of the present disclosure, the first predetermined range is a range within which a brightness value of the actually-measured Gamma curve is not greater than 110% and not smaller than 90% of a brightness value of the standard Gamma curve.

In the embodiments of the present disclosure, the abnormal grayscale may be a grayscale where a difference between an actually-measured transmittance and a standard transmittance on the standard Gamma curve corresponding to the grayscale voltage is greater than a predetermined value. To be specific, the grayscale voltage applied to the white subpixel corresponding to the abnormal grayscale may be adjusted at an adjustment ratio of 0.1% to 5%.

In a possible embodiment of the present disclosure, the adjustment ratio may be 1%. During the adjustment, the grayscale voltage applied to the white subpixel may be adjusted at first in accordance with a larger adjustment ratio, and then with a smaller adjustment ratio. For example, in the case that the actually-measured Gamma transmittance is smaller than the Gamma transmittance on the standard Gamma curve corresponding to the grayscale, the grayscale voltage applied to the white subpixel may be incremented by 1%, and in the case that the adjusted actually-measured Gamma transmittance is greater than the Gamma transmittance on the standard Gamma curve corresponding to the grayscale, the grayscale voltage applied to the white subpixel may be decremented by 0.5%.

In some embodiments of the present disclosure, the step of adjusting the grayscale voltage applied to the white subpixel corresponding to the abnormal grayscale includes: in the case that there is a positive difference between the second actually-measured Gamma curve and the standard Gamma curve at the abnormal grayscale, decreasing the grayscale voltage applied to the white subpixel corresponding to the abnormal grayscale in accordance with a predetermined first adjustment ratio; in the case that there is a negative difference between the second actually-measured Gamma curve and the standard Gamma curve at the abnormal grayscale, increasing the grayscale voltage applied to the white subpixel corresponding to the abnormal grayscale in accordance with a predetermined second adjustment ratio; and determining whether or not there is still a difference between the second actually-measured Gamma curve and the standard Gamma curve at the abnormal grayscale after the adjustment of the grayscale voltage applied to the white subpixel corresponding to the abnormal grayscale, and in the case that there is still the difference, continuing to decrease or increase the grayscale voltage applied to the white subpixel corresponding to the abnormal grayscale in accordance with the predetermined first or second adjustment ratio.

In a possible embodiment of the present disclosure, the first adjustment ratio and the second adjustment ratio are each within a range from 0.1% to 5%. Preferably, the first adjustment ratio and the second adjustment ratio are each 1%.

In a possible embodiment of the present disclosure, the abnormal grayscale includes, among all the grayscales, top 20 to 30 grayscales at which there are the largest differences between transmittances of the actually-measured Gamma curve and transmittances of the standard Gamma curve.

Figure 2:
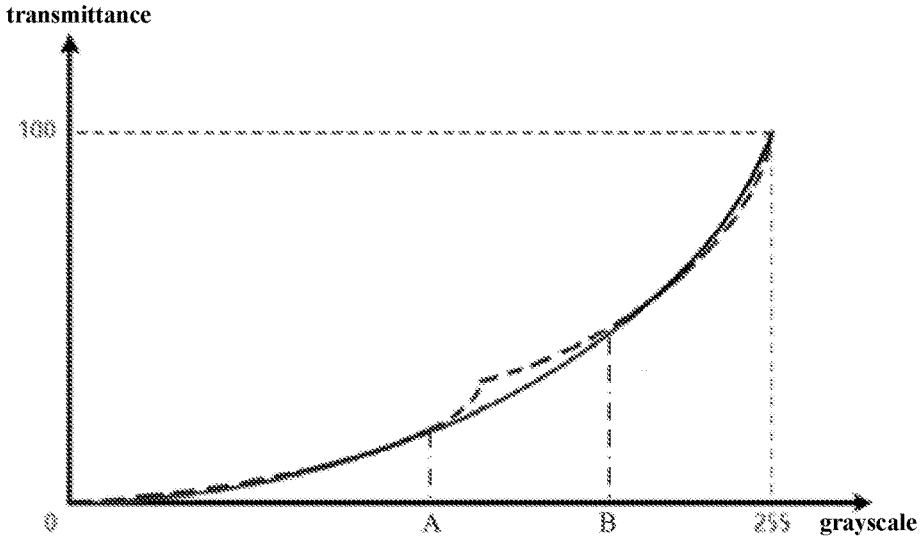
FIG. 2 is a schematic view showing an actually-measured Gamma curve and a standard Gamma curve according to some embodiments of the present disclosure.

To be specific, the actually-measured transmittances at all the grayscales may be compared with the transmittances on the standard Gamma curve at the corresponding grayscales respectively, then the grayscales may be ranked in a descending order in accordance with the differences, and then the top 10% of the grayscales may be taken as the abnormal grayscales, which are about 25 or 26 abnormal grayscales. As shown in FIG. 2, the grayscales between a grayscale with a value A and a grayscale with a value B may be taken as the abnormal grayscales. In FIG. 2, the dotted line represents the actually-measured Gamma curve, and the solid line represents the standard Gamma curve.

Figure 3:
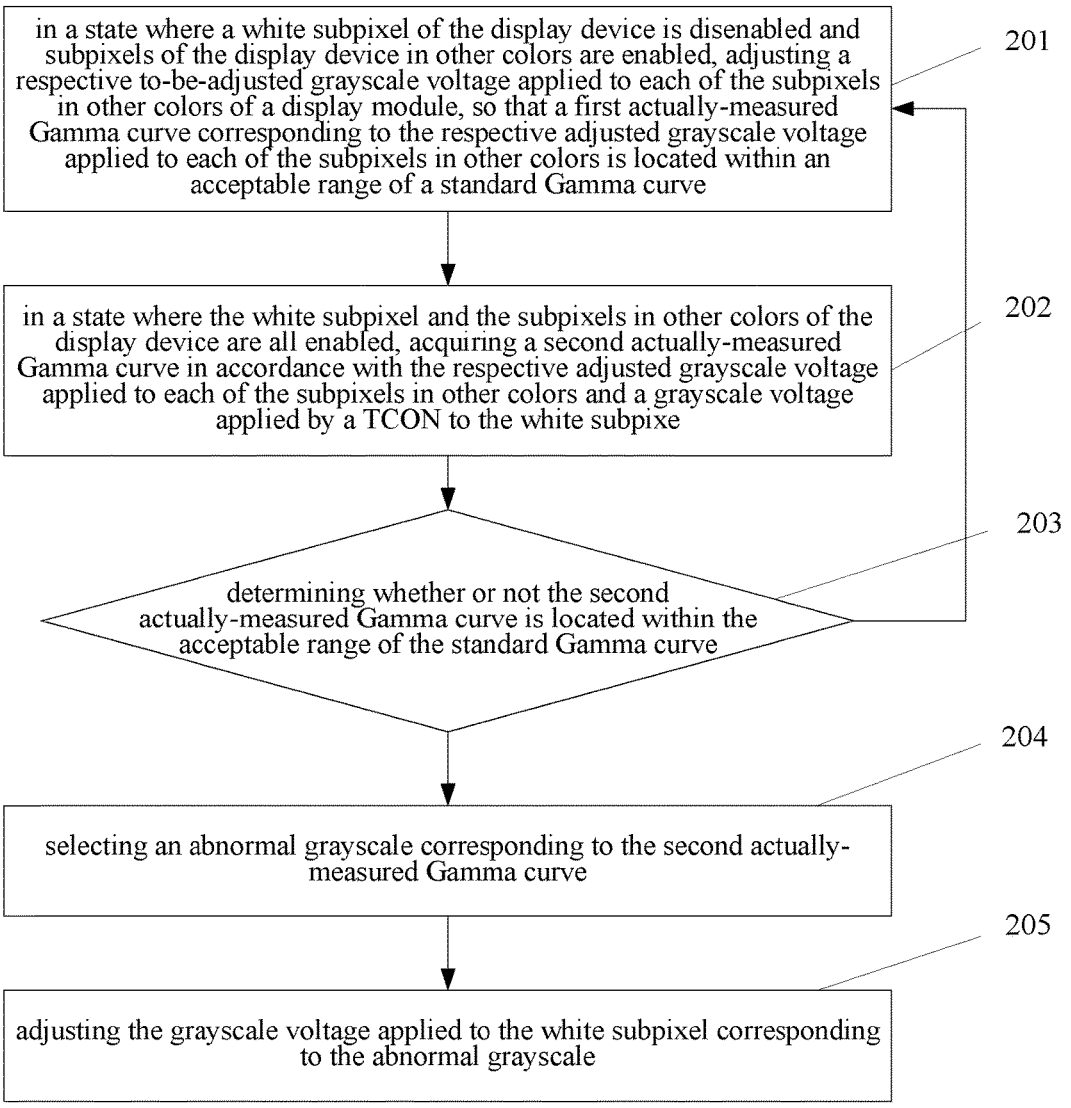
FIG. 3 is another flow chart of the grayscale voltage debugging method according to some embodiments of the present disclosure.

In a possible embodiment of the present disclosure, as shown in FIG. 3, the grayscale voltage debugging method may include the following steps.

Step 201: in the state where the white subpixel of the display module is disenabled and the subpixels in other colors are enabled, adjusting, in a pixel-by-pixel manner, the respective to-be-adjusted grayscale voltage applied to each of the subpixels in other colors of the display module, so that the first actually-measured Gamma curve corresponding to the respective adjusted grayscale voltage applied to each of the subpixels in other colors is located within the acceptable range of the standard Gamma curve.

Step 202: in the state where the white subpixel and the subpixels in other colors of the display device are all enabled, acquiring the second actually-measured Gamma curve in accordance with the respective adjusted grayscale voltage applied to each of the subpixels in other colors and the grayscale voltage applied by the TCON to the white subpixel.

Step 203: determining whether or not the second actually-measured Gamma curve is located within the acceptable range of the standard Gamma curve; in the case that the second actually-measured Gamma curve is not located within the acceptable range of the standard Gamma curve, changing the respective adjusted grayscale voltage applied to each of the subpixels in other colors, taking the changed grayscale voltage as a new respective to-be-adjusted grayscale voltage, and returning to Step 201; and in the case that the second actually-measured Gamma curve is located within the acceptable range of the standard Gamma curve, proceeding to Step 204.

Step 204: selecting the abnormal grayscale corresponding to the second actually-measured Gamma curve.

Step 205: adjusting the grayscale voltage applied to the white subpixel corresponding to the abnormal grayscale, so as to enable the difference between the standard Gamma curve and the second actually-measured Gamma curve at the abnormal grayscale to be within the first predetermined range; in the case that there is a positive difference between the actually-measured transmittance and the transmittance on the standard Gamma curve corresponding to the abnormal grayscale, decreasing the grayscale voltage corresponding to the abnormal grayscale; and in the case that there is a negative difference between the actually-measured transmittance and the transmittance on the standard Gamma curve corresponding to the abnormal grayscale, increasing the grayscale voltage corresponding to the abnormal grayscale.

In some other embodiments of the present disclosure, the above Steps 204 and 205 may not be performed. In the case that the determination result in Step 203 is yes, the respective adjusted grayscale voltage applied to each of the subpixels in other colors and the current grayscale voltage applied to the white subpixel may be taken as the final grayscale voltages.

Figure 4:
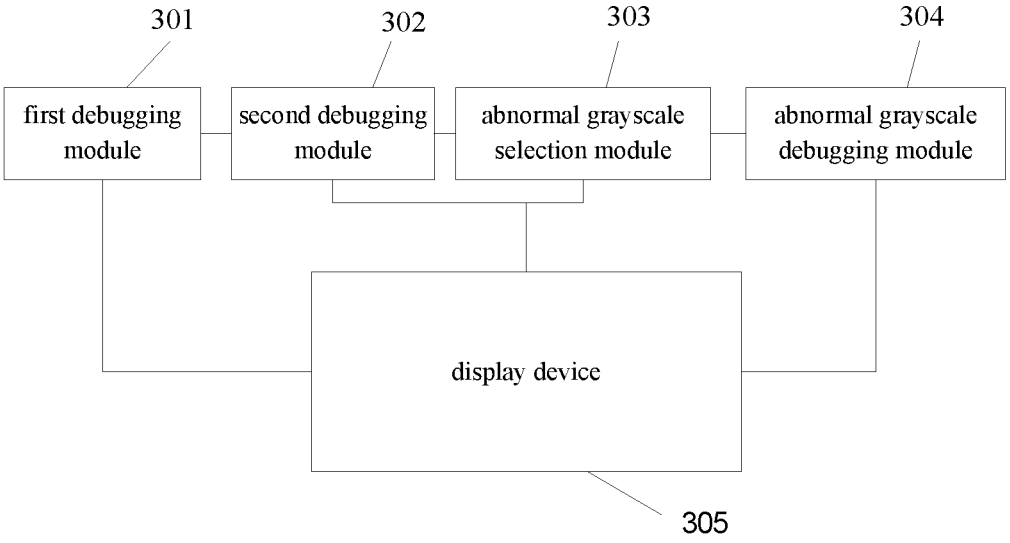
FIG. 4 is a schematic view showing a grayscale voltage debugging device according to some embodiments of the present disclosure.

The present disclosure further provides in some embodiments a grayscale voltage debugging device for debugging a display device including a white subpixel which, as shown in FIG. 4, includes: a first debugging module 301 configured to, in a state where the white subpixel of the display device 305 is disenabled and subpixels in other colors are enabled, adjust, in a pixel-by-pixel manner, a respective to-be-adjusted grayscale voltage applied to each of the subpixels in other colors of a display module, so that a first actually-measured Gamma curve corresponding to the respective adjusted grayscale voltage applied to each of the subpixels in other colors is located within an acceptable range of a standard Gamma curve; and a second debugging module 302 configured to, in a state where the white subpixel and the subpixels in other colors of the display device 305 are all enabled, acquire a second actually-measured Gamma curve in accordance with the respective adjusted grayscale voltage applied to each of the subpixels in other colors and a grayscale voltage applied by a TCON to the white subpixel, determine whether or not the second actually-measured Gamma curve is located within the acceptable range of the standard Gamma curve, in the case that the second actually-measured Gamma curve is located within the acceptable range of the standard Gamma curve, take the respective adjusted grayscale voltage applied to each of the subpixels in other colors and the current grayscale voltage applied to the white subpixel as the final grayscale voltages, and in the case that the second actually-measured Gamma curve is not located within the acceptable range of the standard Gamma curve, change the respective adjusted grayscale voltage applied to each of the subpixels in other colors, and take the changed grayscale voltage as a new respective to-be-adjusted grayscale voltage, and return to the first step.

In a possible embodiment of the present disclosure, still with reference to FIG. 4, the grayscale voltage debugging device may further include: an abnormal grayscale selection module 303 configured to select an abnormal grayscale corresponding to the second actually-measured Gamma curve; and an abnormal grayscale adjustment module 304 configured to adjust the grayscale voltage applied to the white subpixel corresponding to the abnormal grayscale, so as to enable a difference between the standard Gamma curve and the second actually-measured Gamma curve at the abnormal grayscale to be within a first predetermined range.

In a possible embodiment of the present disclosure, the first predetermined range is a range within which a brightness value of the actually-measured Gamma curve is not greater than 110% and not smaller than 90% of a brightness value of the standard Gamma curve.

In a possible embodiment of the present disclosure, the abnormal grayscale adjustment module includes: a positive adjustment unit configured to, in the case that there is a positive difference between the second actually-measured Gamma curve and the standard Gamma curve at the abnormal grayscale, decrease the grayscale voltage applied to the white subpixel corresponding to the abnormal grayscale in accordance with a predetermined first adjustment ratio; a negative adjustment unit configured to, in the case that there is a negative difference between the second actually-measured Gamma curve and the standard Gamma curve at the abnormal grayscale, increase the grayscale voltage applied to the white subpixel corresponding to the abnormal grayscale in accordance with a predetermined second adjustment ratio; and a difference determination unit configured to determine whether or not there is still a difference between the second actually-measured Gamma curve and the standard Gamma curve at the abnormal grayscale after the adjustment of the grayscale voltage applied to the white subpixel corresponding to the abnormal grayscale, and in the case that there is still the difference, enable the operation of the positive adjustment unit or the negative adjustment unit.

In some embodiments of the present disclosure, the first adjustment ratio and the second adjustment ratio are each within a range from 0.1% to 5%.

In some embodiments of the present disclosure, the abnormal grayscale includes, among all the grayscales, top 20 to 30 grayscales at which there are the largest differences between transmittances of the actually-measured Gamma curve and transmittances of the standard Gamma curve.

The present disclosure further provides a display device including the above-mentioned grayscale voltage debugging device.

In a possible embodiment of the present disclosure, the time controller is provided with an interface for adjusting a grayscale voltage applied to a white subpixel.

It can be seen from above that, according to the grayscale voltage debugging method, the grayscale voltage debugging device and the display device in the embodiments of the present disclosure, the white subpixel is disenabled by the TCON, and then the grayscale voltages applied to the RGB subpixels are adjusted through the Gamma chip. Upon the acquisition of the actually-measured Gamma curved with the smallest error, the grayscale voltage applied to the white subpixel may be adjusted through the interface of the chip of the TCON, so as to improve the transmittance and the grayscale brightness and enable the actually-measured Gamma curve to be closest to the standard Gamma curve, thereby to improve the actually-measured Gamma curve, reduce the error due to the adjustment of the grayscale voltage applied to the white subpixel and improve a grayscale voltage debugging effect.

It should be appreciated that, the above-mentioned embodiments are for illustrative purposes only, and shall not be used to limit the scope of the present disclosure. In addition, these embodiments and the features therein may be combined in the case of no conflict.

Obviously, a person skilled in the art may make further modifications and improvements without departing from the spirit of the present disclosure, and these modifications and improvements shall also fall within the scope of the present disclosure.

What is claimed is:

1. A grayscale voltage debugging method for debugging a display device comprising a white subpixel, comprising:

a first step of, in a state where the white subpixel of the display device is disabled and subpixels in other colors of the display device are enabled, adjusting, in a pixel-by-pixel manner, a respective to-be-adjusted grayscale voltage applied to each of the subpixels in other colors of a display module, to enable a first actually-measured Gamma curve corresponding to the respective adjusted grayscale voltage applied to each of the subpixels in other colors to be located within an acceptable range of a standard Gamma curve; and a second step of, in a state where the white subpixel and the subpixels in other colors of the display device are all enabled, acquiring a second actually-measured Gamma curve in accordance with the respective adjusted grayscale voltage applied to each of the subpixels in other colors and a grayscale voltage applied by a time controller (TCON) to the white subpixel, determining whether or not the second actually-measured Gamma curve is located within the acceptable range of the standard Gamma curve, and in the case that the second actually-measured Gamma curve is not located within the acceptable range of the standard Gamma curve, changing the respective adjusted grayscale voltage applied to each of the subpixels in other colors, taking the changed grayscale voltage as a new respective to-be-adjusted grayscale voltage, and returning to the first step, wherein in the case that the second actually-measured Gamma curve is located within the acceptable range of the standard Gamma curve, the grayscale voltage debugging method further comprises:

selecting an abnormal grayscale corresponding to the second actually-measured Gamma curve; and adjusting the grayscale voltage applied to the white subpixel corresponding to the abnormal grayscale, to enable a difference between the standard Gamma curve and the second actually-measured Gamma curve at the abnormal grayscale to be within a first predetermined range, wherein the first predetermined range is a range within which a brightness value of the actually-measured Gamma curve is not greater than 110% and not smaller than 90% of a brightness value of the standard Gamma curve.

2. The grayscale voltage debugging method according to claim 1, wherein the step of adjusting the grayscale voltage applied to the white subpixel corresponding to the abnormal grayscale comprises:

in the case that there is a positive difference between the second actually-measured Gamma curve and the standard Gamma curve at the abnormal grayscale, decreasing the grayscale voltage applied to the white subpixel corresponding to the abnormal grayscale in accordance with a predetermined first adjustment ratio;

in the case that there is a negative difference between the second actually-measured Gamma curve and the standard Gamma curve at the abnormal grayscale, increasing the grayscale voltage applied to the white subpixel corresponding to the abnormal grayscale in accordance with a predetermined second adjustment ratio; and determining whether or not there is still a difference between the second actually-measured Gamma curve and the standard Gamma curve at the abnormal grayscale after the adjustment of the grayscale voltage applied to the white subpixel corresponding to the abnormal grayscale, and in the case that there is still the difference, continuing to decrease or increase the grayscale voltage applied to the white subpixel corresponding to the abnormal grayscale in accordance with the predetermined first or second adjustment ratio.

3. The grayscale voltage debugging method according to claim 2, wherein the first adjustment ratio and the second adjustment ratio are each within a range from 0.1% to 5%.

4. The grayscale voltage debugging method according to claim 1, wherein the abnormal grayscale comprises, among all the grayscales, top 20 to 30 grayscales at which there are the largest differences between transmittances of the actually-measured Gamma curve and transmittances of the standard Gamma curve.

5. A grayscale voltage debugging device for debugging a display device comprising a white subpixel, comprising:

a first debugging module configured to, in a state where the white subpixel of the display device is disabled and subpixels in other colors of the display device are enabled, adjust, in a pixel-by-pixel manner, a respective to-be-adjusted grayscale voltage applied to each of the subpixels in other colors of a display module, to enable a first actually-measured Gamma curve corresponding to the respective adjusted grayscale voltage applied to each of the subpixels in other colors to be located within an acceptable range of a standard Gamma curve;

a second debugging module configured to, in a state where the white subpixel the subpixels in other colors of the display device are all enabled, acquire a second actually-measured Gamma curve in accordance with the respective adjusted grayscale voltage applied to each of the subpixels in other colors and a grayscale voltage applied by a time controller (TCON) to the white subpixel, determine whether or not the second actually-measured Gamma curve is located within the acceptable range of the standard Gamma curve, and in the case that the second actually-measured Gamma curve is not located within the acceptable range of the standard Gamma curve, change the respective adjusted grayscale voltage applied to each of the subpixels in other colors, and take the changed grayscale voltage as a new respective to-be-adjusted grayscale voltage, and return to the first debugging module;

an abnormal grayscale selection module configured to, in the case that the second debugging module determines that the second actually-measured Gamma curve is located within the acceptable range of the standard Gamma curve, select an abnormal grayscale corresponding to the second actually-measured Gamma curve; and an abnormal grayscale adjustment module configured to adjust the grayscale voltage applied to the white subpixel corresponding to the abnormal grayscale, to enable a difference between the standard Gamma curve and the second actually-measured Gamma curve at the abnormal grayscale to be within a first predetermined range, wherein the first predetermined range is a range within which a brightness value of the actually-measured Gamma curve is not greater than 110% and not smaller than 90% of a brightness value of the standard Gamma curve.

6. The grayscale voltage debugging device according to claim 5, wherein the abnormal grayscale adjustment module comprises:

a positive adjustment unit configured to, in the case that there is a positive difference between the second actually-measured Gamma curve and the standard Gamma curve at the abnormal grayscale, decrease the grayscale voltage applied to the white subpixel corresponding to the abnormal grayscale in accordance with a predetermined first adjustment ratio;

a negative adjustment unit configured to, in the case that there is a negative difference between the second actually-measured Gamma curve and the standard Gamma curve at the abnormal grayscale, increase the grayscale voltage applied to the white subpixel corresponding to the abnormal grayscale in accordance with a predetermined second adjustment ratio; and a difference determination unit configured to determine whether or not there is still a difference between the second actually-measured Gamma curve and the standard Gamma curve at the abnormal grayscale after the adjustment of the grayscale voltage applied to the white subpixel corresponding to the abnormal grayscale, and in the case that there is still the difference, enable the operation of the positive adjustment unit or the negative adjustment unit.

7. The grayscale voltage debugging device according to claim 6, wherein the first adjustment ratio and the second adjustment ratio are each within a range from 0.1% to 5%.

8. The grayscale voltage debugging device according to claim 5, wherein the abnormal grayscale comprises, among all the grayscales, top 20 to 30 grayscales at which there are the largest differences between transmittances of the actually-measured Gamma curve and transmittances of the standard Gamma curve.

9. A display device comprising the grayscale voltage debugging device according to claim 5.

10. The display device according to claim 9, wherein the time controller is provided with an interface for adjusting a grayscale voltage applied to a white subpixel.

11. The display device according to claim 9, wherein the abnormal grayscale adjustment module comprises:

a positive adjustment unit configured to, in the case that there is a positive difference between the second actually-measured Gamma curve and the standard Gamma curve at the abnormal grayscale, decrease the grayscale voltage applied to the white subpixel corresponding to the abnormal grayscale in accordance with a predetermined first adjustment ratio;

a negative adjustment unit configured to, in the case that there is a negative difference between the second actually-measured Gamma curve and the standard Gamma curve at the abnormal grayscale, increase the grayscale voltage applied to the white subpixel corresponding to the abnormal grayscale in accordance with a predetermined second adjustment ratio; and a difference determination unit configured to determine whether or not there is still a difference between the second actually-measured Gamma curve and the standard Gamma curve at the abnormal grayscale after the adjustment of the grayscale voltage applied to the white subpixel corresponding to the abnormal grayscale, and in the case that there is still the difference, enable the operation of the positive adjustment unit or the negative adjustment unit.

12. The display device according to claim 11, wherein the first adjustment ratio and the second adjustment ratio are each within a range from 0.1% to 5%.

13. The display device according to claim 9, wherein the abnormal grayscale comprises, among all the grayscales, top 20 to 30 grayscales at which there are the largest differences between transmittances of the actually-measured Gamma curve and transmittances of the standard Gamma curve.

14. The display device according to claim 9, wherein the time controller is provided with an interface for adjusting a grayscale voltage applied to a white subpixel.

15. A grayscale voltage debugging method for debugging a display device comprising a white subpixel, comprising:

a first step of, in a state where the white subpixel of the display device is disabled and subpixels in other colors of the display device are enabled, adjusting, in a pixel-by-pixel manner, a respective to-be-adjusted grayscale voltage applied to each of the subpixels in other colors of a display module, to enable a first actually-measured Gamma curve corresponding to the respective adjusted grayscale voltage applied to each of the subpixels in other colors to be located within an acceptable range of a standard Gamma curve; and a second step of, in a state where the white subpixel and the subpixels in other colors of the display device are all enabled, acquiring a second actually-measured Gamma curve in accordance with the respective adjusted grayscale voltage applied to each of the subpixels in other colors and a grayscale voltage applied by a time controller (TCON) to the white subpixel, determining whether or not the second actually-measured Gamma curve is located within the acceptable range of the standard Gamma curve, and in the case that the second actually-measured Gamma curve is not located within the acceptable range of the standard Gamma curve, changing the respective adjusted grayscale voltage applied to each of the subpixels in other colors, taking the changed grayscale voltage as a new respective to-be-adjusted grayscale voltage, and returning to the first step, wherein in the case that the second actually-measured Gamma curve is located within the acceptable range of the standard Gamma curve, the grayscale voltage debugging method further comprises:

selecting an abnormal grayscale corresponding to the second actually-measured Gamma curve; and adjusting the grayscale voltage applied to the white subpixel corresponding to the abnormal grayscale, to enable a difference between the standard Gamma curve and the second actually-measured Gamma curve at the abnormal grayscale to be within a first predetermined range, wherein the abnormal grayscale comprises, among all the grayscales, top 20 to 30 grayscales at which there are the largest differences between transmittances of the actually-measured Gamma curve and transmittances of the standard Gamma curve.

* * * * *